United States Patent [19]

Stephens et al.

[11] Patent Number: 4,966,253

[45] Date of Patent: Oct. 30, 1990

[54] MUFFLER DEVICE FOR EXHAUST SYSTEMS

[76] Inventors: Howard Stephens, 120 Price Hill Trail, Sugar Hill, Ga. 30518; Roy W. Clark, 2526 McCormick Rd., Panama City, Fla. 32409

[21] Appl. No.: 397,239

[22] Filed: Aug. 23, 1989

[51] Int. Cl.[5] ..... F01N 7/08

[52] U.S. Cl. ..... 181/227; 181/255; 181/264; 181/269

[58] Field of Search ..... 181/227, 228, 240, 243, 181/247, 250, 251, 264, 268, 269, 232, 255

[56] References Cited

U.S. PATENT DOCUMENTS

| | | | |
|---|---|---|---|
| 1,697,794 | 1/1929 | Stranahan | 181/240 |
| 3,964,570 | 6/1976 | Morrow | 181/268 |
| 4,109,753 | 8/1978 | Lyman | 181/264 X |
| 4,222,456 | 9/1980 | Kasper | 181/251 X |

FOREIGN PATENT DOCUMENTS

| | | | |
|---|---|---|---|
| 1152871 | 2/1958 | France | 181/264 |

*Primary Examiner*—Benjamin R. Fuller

[57] ABSTRACT

A muffler device for reducing the noise level of an internal combustion engine as exhaust gases and sound waves produced by the operation of the engine are expelled into the atmosphere is disclosed. The device is placed in the exhaust system, being disposed within the exhaust pipe or pipes as close to the exhaust manifold as possible. The device has a sound chamber for attenuating sound waves entering the chamber by deflection of the sound waves back toward their source and a venturi for drawing exhaust gases through the device and expelling them to the atmosphere.

17 Claims, 1 Drawing Sheet

MUFFLER DEVICE FOR EXHAUST SYSTEMS

BACKGROUND OF THE INVENTION

1. Field of the Invention

This invention relates to a device for limiting the noise level of a fuel burning engine as exhaust gases pass through the exhaust pipe and are expelled to the atmosphere. The invention muffles and deflects sound waves generated by the engine as exhaust is produced and expelled and allows exhaust gases to escape with minimal back pressure on the exhaust system.

2. Description of the Prior Art

A muffler or sound suppressant is a common device used in most types of internal combustion engines. While several devices are known which accomplish some reduction in engine noise, no device is known which accomplishes all of the objectives of the disclosed invention, that is to provide an efficient noise reducing apparatus, which minimizes manufacturing costs and is easy to install. The present invention also minimizes the back pressure associated with diffusion of the exhaust gases.

Known to the applicant is Lyman, U.S. Pat. No. 4,109,753. Lyman discloses a muffler assembly which includes a single flow control means such as a diffuser having a centrally disposed baffle with radially extending deflection vanes and with axially extending tabs. The deflector vanes are twisted to define an angle of deflection varying from 35° to 55° to diffuse the air flow going into the main component. However, the primary means of noise reduction is sound attenuating material such as glass fiber surrounding the exhaust pipe. Diffusion of the exhaust in the manner disclosed also creates back pressure on the exhaust system with more back pressure created as the number of deflector vanes are increased.

None of the known prior art however, accomplishes all of the objectives of the present invention. The disclosed invention provides a sound suppressant for an exhaust system which is placed in the exhaust pipe rather than the tail pipe of an exhaust system which greatly reduces the noise level of the engine. The symmetry and simplicity of design provides a substantial reduction in cost and installation time of the present muffler device over the known prior art.

SUMMARY OF THE INVENTION

It is, therefore, one object of the invention to provide a muffler device for an exhaust system which substantially reduces the noise level of the engine as exhaust is expelled.

It is another object of the invention to provide a sound suppressant which is easily installed and which is designed to prevent the possibility of incorrect installation.

It is yet another object of the invention to provide a device that is inexpensive to manufacture and is durable for the life of the exhaust system of an engine.

It is a further object of the invention to minimize or eliminate back pressure as exhaust gases are being diffused prior to release through the use of the present device.

A preferred embodiment for the present muffler device used in connection with an internal combustion fuel burning engine exhaust system as described herein is characterized by a sound chamber for reducing the noise level of the engine and a venturi for releasing exhaust to the atmosphere. The device fits inside and contacts the interior of an exhaust pipe and consists of an outer pipe-shaped casing or housing having two opposite ends which are cut so as to form a plurality of tabs extending from and about the ends of the pipe casing. Alternating tabs surrounding each end of the pipe casing are bent radially inwardly to form a perforated cover and a hooded portion over each open end of the pipe casing. A narrow pipe runs axially through the center of the outer pipe casing. The narrow pipe has a collar surrounding each of its ends to retain the center pipe in place concentrically within the outer casing. As exhaust is expelled by the engine, it is directed through the disclosed invention. Sound waves enter an internal chamber between the outer and inner pipes by spaces created between the alternating inwardly bent tabs and is deflected by alternating tabs on the opposite side of the outer pipe casing. Exhaust gases are drawn through the narrow pipe so that no back pressure occurs as exhaust escapes through the device.

Various additional objects and advantages of the present invention will become apparent from the following description, with reference to the accompanying drawings.

DETAILED DESCRIPTION OF THE DISCLOSED EMBODIMENT

Figure 1:
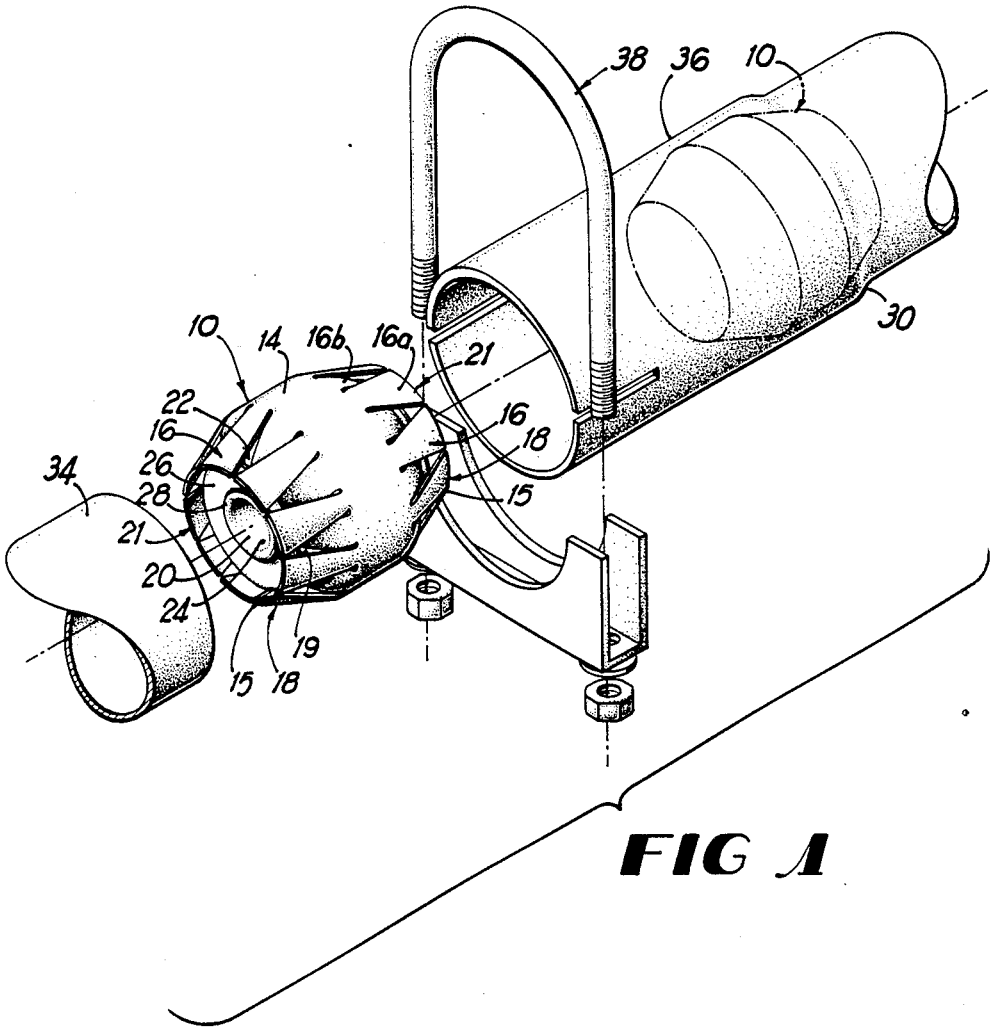
FIG. 1 is a partial, exploded perspective view of the disclosed invention as used in conjunction with the exhaust system of a fuel burning engine.
Figure 2:
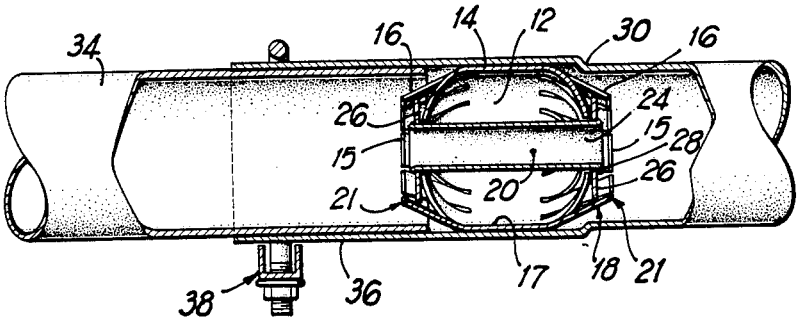
FIG. 2 is a partial, cross-sectional view showing the disclosed invention in installed position in an exhaust system of a fuel burning engine.

A preferred exemplary embodiment of our invention is illustrated in FIGS. 1–2 wherein like numerals represent like parts. A preferred embodiment of the disclosed invention is generally indicated by the numeral 10. The sound muffler device 10 is generally symmetrical about a longitudinal axis so that either end may be inserted into the exhaust pipe first. The device has a chamber 12 which receives sound waves from the engine exhaust and redirects the sound waves back toward the source, thus having the effect of cancelling the major portion of the sound waves coming through the exhaust system.

The chamber 12 is defined by a generally cylindrical outer pipe or housing 14 having opposite ends 15. In each end, a plurality of lengthwise cuts are made which extend axially approximately one-third of the length of the pipe 14. This forms a plurality of tab means 16 extending axially from each end of the pipe. The cuts in the opposite ends of the outer pipe 14 are off-set slightly from one another so that a cut defining an edge of a tab 16 on one end of the pipe is opposite the approximate center of a tab 16 extending from the other end of the pipe, as best shown in FIG. 1. The tabs 16 are then bent inwardly with alternating tabs extending from a single end of the pipe being bent either slightly or radically inwardly. The tabs bent slightly are designated as **16*a*, while the radically bent tabs are designated as 16*b***.

Radically inwardly bent tabs **16*b* form an angle relative to the interior wall 17 of the chamber 12 which ranges from approximately 90° to 110°. The angle of the slightly inwardly bent tabs 16*a*, relative to the interior wall 17 of chamber 12**, ranges from approximately 120° to 175°.

The radically inwardly bent tabs 16b together form a perforated cover means 18 for chamber 12 at each end thereof. The plurality of gaps in said cover means allow exhaust gases to pass into the interior of the pipe end 15 nearest the engine. A central aperture 20 is formed between the outer ends of the tabs 16b as they turn inwardly toward each other and side gaps 22 are formed between the tabs 16b due to the alternating bending degree of the tabs. Thus, as shown in FIG. 1, tabs 16a are formed so as to narrow the ends of pipe member 14 while coming together toward the center of pipe 14. This provides a narrowed enclosure at each end of pipe 14 for admission of exhaust gases, forming a sort of funnel or directional means.

An inner tube or pipe 24 extends axially through the center of the outer pipe 14. The inner pipe 24 is shorter than the total length of the outer pipe 14 and longer than the distance between the cover means 18 formed over the interior of each end of the outer pipe 14 by the radically inwardly bent tabs 16b. A washer or collar 26 surrounds each end of the inner pipe 24 and is held in place over the tabs 16b by a lip 28 formed at each end of the inner pipe by flaring the end of pipe 24 outwardly. The collar 26 sits over the cover means 18 formed by the radically inwardly bent tabs 16b and inside the narrowed enclosure formed by the slightly inwardly bent tabs 16a.

The muffler device 10 has approximately the same outer diameter as the inner diameter of the exhaust pipe. The outer diameter is, however, slightly less than that of the exhaust pipe such that the present device may be placed within and in contact with the exhaust pipe close to the exhaust, manifold of the engine. FIG. 1 shows the exhaust pipe 36 and the present invention 10 in installed position. The close tolerance between the inner circumference, the exhaust pipe and the outer circumference of the present device aids in holding the device in position. In addition, any variations in the inner circumference of the exhaust pipe, as illustrated by the narrowed dimension of the exhaust pipe designated by numeral 30, also serve to maintain the device in place. As shown in FIG. 2, the tail pipe 34 of the exhaust system, inserted into the exhaust pipe 26, may also serve to maintain the device 10 in place within the exhaust pipe as the tail pipe 34 is of a slightly smaller diameter than the exhaust pipe 26 and may abut the exterior of the muffler 10. The tail pip 34 is clamped to the exhaust pipe with a conventional pipe clamping means 38. Thus, there is no requirement for a separate securing means for the present muffler device 10 within the exhaust pipe 26. The close tolerance of the device and the exhaust pi combined with the retention of the device by the tail pipe 34 serve to secure the device 10 in place.

With the muffler 10 securely placed within the exhaust system, it operates to disperse sound from the engine as exhaust is expelled into the atmosphere. The exhaust gases travel from the exhaust manifold of the engine through the exhaust system along with sound waves from the operation of the engine. The exhaust is forced through the exhaust pipe and into the narrowed enclosure of the outer pipe 14.

Thus, exhaust gases and accompanying sound waves enter into the sound chamber 12 of the device through the side gaps 22 formed between the slightly inwardly and radically inwardly bent tabs 16a and 16b and are directed through the sound chamber 12. The sound waves are then redirected back toward their source by offset alternate radically inwardly dents tabs 16b on the opposite end of the sound chamber 12. The effect of the deflection is to attenuate the major portion of the sound waves traveling through the exhaust system.

The gases from the engine are directed through the device while the sound waves traveling with the exhaust are attenuated through deflection. The exhaust is forced through the present muffler device 10 upon its expulsion from the engine. The exhaust first meets the narrowed portion 21 of the outer pipe 14 and is slightly dispersed as it is passed through the openings 19 between the tabs 16a. The exhaust is then directed through the cover means 18 and the narrow tube 24. The exhaust is further dispersed by entering the chamber 12 through the gaps 22 of the covering 18. The narrow tube 24 acts as a venturi pipe rapidly drawing exhaust fumes through the device to the tail pipe as the sound waves enter the chamber 12. The narrow tube 24 is loosely contained within the radically inwardly bent tabs 16b and surrounding collars 26 so that particles from the exhaust cannot build up between the space formed between the flared lips which anchor the narrow pipe 24 and the collars. The gases from the exhaust are drawn through the pipe 24 at a sufficient rate so that substantially no back pressure is created by the disposal of the device in the exhaust pipe.

The ideal construction material for the sound suppressant device is stainless steel, although it can also be constructed of any metal or material appropriately used in an exhaust system. The sound suppressant device 10 is also easily installed due to the symmetrical construction thereof, each end being generally identical.

As seen from the foregoing description, the muffler device herein described provides advantages over previously known mufflers due to its unique form and characteristics. The device disclosed herein is unique in that it can be placed in the exhaust pipe close to the exhaust manifold of an engine. It is, thus, more efficient in sound reduction due to its location within the system closer to the source of sound. The present device can be used in conjunction with any fuel burning engine. Use with cars and lawn mower engines are among many applications of the disclosed invention. The device is also much smaller and lighter than conventional mufflers, providing further advantages with regard to installation, storage, and fuel efficiency of the vehicle due to weight reduction. The device can also be inexpensively manufactured in sizes standardized with regard to pipe sizes due to its disposal within the pipe.

Thus, while an embodiment of the a muffler device for exhaust systems and modifications thereof have been shown and described in detail hereinabove, various additional changes and modifications may be made without departing from the scope of the present invention.

We claim:

1. A muffler device for installation within an exhaust pipe of an engine the exhaust pipe being of a given inner circumference, the muffler serving to attenuate sound carried by engine exhaust gases passing through said exhaust pipe, comprising an outer pipe member having an outer circumference slightly less than the inner circumference of said exhaust pipe and a hollow center, said outer pipe member including tabs at each end thereof, said tabs being directed inwardly toward the hollow center of said outer pipe member forming a chamber within said outer pipe member having a narrowed opening relative to said outer circumference of said outer pipe member at each end thereof, a hollow inner pipe member disposed within said outer pipe member, said inner pipe member having a collar around each end thereof, said collars confining said inner pipe member between the tabs of the outer pipe member and within said chamber, whereby the engine exhaust gases passing through the exhaust pipe must pass through said muffler.

2. A muffler device as defined in claim 1 in which said device includes collar means disposed between said tab means and said ends of said inner pipe member and receiving said ends of said inner pipe member therewithin for maintaining said inner pipe member in concentric relationship with said outer pipe member.

3. A muffler device as defined in claim 1 in which said device includes a second set of tab means at each end of said pipe member extending inwardly from said outer pipe member and terminating outwardly of said first-mentioned tab means, said second set of tab means on one end of said outer pipe member being offset from said second tab means on the opposite end of said outer pipe member for creating a staggered relationship between said respective tab means for creating a sound attenuating chamber.

4. A muffler device as defined in claim 3 in which said second set of tab means forms a narrowed funnel means for directing exhaust gases toward said chamber and said inner pipe means.

5. The muffler device of claim 1 wherein said outer pipe has an interior wall and the tabs comprise a first set and a second set of tabs, the first set of tabs forming substantially right angles to the interior wall.

6. The muffler device of claim 5 wherein the second set of tabs form obtuse angles with respect to the interior wall.

7. The muffler device of claim 1 wherein said inner pipe member serves as a venturi to draw exhaust gases away from the engine.

8. A muffler for being snugly received in an exhaust pipe of an automobile, said exhaust pipe having an inner diameter, the muffler serving to attenuate sound carried by engine exhaust gases passing through said exhaust pipe comprising:

(a) a central tube, through which exhaust gases in the exhaust pipe pass, said central tube having a forward end and a distal end;

(b) an outer housing encircling said central tube, said outer housing having an outer diameter substantially the same as the inner diameter of said exhaust pipe, so that said housing may be retained in place when inserted into said exhaust pipe, said outer housing being disposed in concentric relationship to said central tube, said outer housing further having a forward end and a distal end;

(c) a plurality of circumferentially spaced inner tabs extending inwardly from both ends of said outer housing, the ends of said inner tabs terminating adjacent to said central tube;

(d) additional outer tabs protruding from the ends of said housing and terminating outwardly of said ends of said inner tabs; and (e) a collar disposed on each end of said central tube, outwardly of the ends of said inner tabs, said outer tabs converging towards each other and terminating outwardly of said collars for retaining said collars between said inner tabs and said outer tabs, whereby the engine exhaust gases passing through the exhaust pipe must pass through said muffler.

9. A muffler as defined in claim 8 in which said additional tabs form a narrowed enclosure for directing exhaust gases and sound waves into said housing.

10. A muffler as defined in claim 8 in which said flared ends of said tube extend outwardly of said first-mentioned tabs.

11. A muffler as defined in claim 10 in which said tube is loosely retained by said first mentioned tabs and said washers for providing a space therebetween preventing particle buildup therearound.

12. A muffler as defined in claim 8 in which said tube is loosely retained by said first mentioned tabs and said washers for providing a space therebetween preventing particle buildup therearound.

13. A muffler device for installation within an exhaust pipe of an engine said exhaust pipe having an inner circumference, the muffler serving to attenuate sound carried by engine exhaust gases emanating therefrom comprising a housing having an outer circumference slightly less than the inner circumference of said exhaust pipe and a hollow center, said housing having a forward and a distal end and including first tab means at each end thereof, said first tab means being directed inwardly toward the center of said housing, an inner pipe member disposed within and in concentric relationship with said housing, said inner pipe member being confined by said first tab means, and second tab means extending from said housing and having ends terminating outwardly of said inner pipe member forming a narrowed enclosure for directing said engine exhaust gases into said inner pipe member whereby the engine exhaust gases passing through the tail pipe must pass through said muffler.

14. A muffler as defined in claim 13 in which said first and second tab means at each end of said housing are respectively disposed in staggered relationship to one another.

15. A muffler as defined in claim 13 in which said device includes collar means disposed between said first tab means and said second tab means.

16. A muffler as defined in claim 15 in which said inner pipe member includes flared end portions for directing gases therein and said collar means are disposed around said inner pipe member adjacent said flared end portions.

17. A muffler as defined in claim 16 in which said collar means are disposed between said first and second tab means on each end thereof.

* * * * *